US006918440B2

(12) United States Patent
Garcia-Soule et al.

(10) Patent No.: US 6,918,440 B2
(45) Date of Patent: Jul. 19, 2005

(54) TESTING DRILL PACKER

(75) Inventors: Virgilio Garcia-Soule, Carrollton, TX (US); Timothy R. Carlson, Addison, TX (US); Chuck MacPhail, Little Elm, TX (US); Imre I. Gazda, Forth Worth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 113 days.

(21) Appl. No.: 10/414,748

(22) Filed: Apr. 16, 2003

(65) Prior Publication Data

US 2004/0206496 A1 Oct. 21, 2004

(51) Int. Cl.[7] ..... E21B 43/12
(52) U.S. Cl. ..... 166/142; 166/373; 166/194
(58) Field of Search ..... 166/373, 250.17, 166/66.7, 116, 122, 126, 128, 131, 133, 141, 142, 194, 145

(56) References Cited

U.S. PATENT DOCUMENTS

| | | | | |
|---|---|---|---|---|
| 3,107,729 A | | 10/1963 | Barry et al. | 166/66 |
| 3,111,169 A | | 11/1963 | Hyde | 166/145 |
| 3,926,254 A | | 12/1975 | Evans et al. | 166/106 |
| 4,345,648 A | | 8/1982 | Kuus | 166/106 |
| 4,453,599 A | | 6/1984 | Fredd | 166/374 |
| 4,648,448 A | | 3/1987 | Sanford et al. | 166/191 |
| 4,749,037 A | | 6/1988 | Christensen | 166/184 |
| 4,776,396 A | | 10/1988 | Studholme | 166/187 |
| 4,830,107 A | | 5/1989 | Rumbaugh | 166/250 |
| 5,400,855 A | * | 3/1995 | Stepp et al. | 166/151 |
| 5,540,280 A | | 7/1996 | Schultz et al. | 166/250.07 |
| 5,803,186 A | | 9/1998 | Berger et al. | 175/50 |
| 6,047,239 A | | 4/2000 | Berger et al. | 702/9 |
| 6,148,664 A | | 11/2000 | Baird | 73/152.38 |
| 6,152,224 A | | 11/2000 | French | 166/250.08 |
| 6,318,469 B1 | | 11/2001 | Patel | 166/305.1 |
| 6,464,006 B2 | * | 10/2002 | Womble | 166/276 |

OTHER PUBLICATIONS

European Search Report (04251818.3–2315), Jul. 6, 2004, 3 pages.

* cited by examiner

*Primary Examiner*—Frank Tsay
(74) *Attorney, Agent, or Firm*—Michael W. Piper

(57) ABSTRACT

One embodiment of the present disclosure describes a test assembly including an inflatable packer. An internal control sleeve controls flow of drilling fluid through an inflation port to inflate and deflate the packer. A shifting tool run on a slick line moves the sleeve. The packer has one end attached to an external sliding sleeve which moves upon packer inflation to expose a formation fluid port through which formation testing is performed. After testing and packer deflation, a circulation port may be opened to recover produced fluids up the drill string. A second sleeve controls flow through the circulation port and is controlled by a second shifting tool run on slick line. Other embodiments include a circulation assembly with a sliding sleeve opened and closed by one shifting tool to control circulation and the sliding sleeve itself and its operation.

40 Claims, 6 Drawing Sheets

TESTING DRILL PACKER

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

This disclosure relates to systems and methods for testing earth formations through a tubing string, and more particularly to a system for inflating a packer to isolate a formation and opening a formation flow path for formation testing and for opening a circulation flow path for removal of formation fluids from a tubing string after testing.

BACKGROUND OF THE INVENTION

In drilling oil and gas wells, it is desirable to obtain information concerning potentially productive earth formations penetrated by the well as each such zone is drilled through. For example, it is desirable to obtain a sample of fluids produced from each formation to determine whether it is oil, gas or water. It is also desirable to measure the flow rate of the fluids and the temperature and pressure in the zone. Numerous systems and methods have been used for these purposes.

Early systems required that the drill string be removed from the borehole. Then a test system would be lowered back into the borehole, possibly on the end of the drill string from which the drill bit had been removed. Such drill stem test systems usually included a packer for isolating the zone to allow pressure testing. They usually included pressure and temperature sensors and recorders and chambers for collected fluid samples. While these are able to collect good information, they are expensive to operate because of the need to remove and replace the drill string twice in order to test and then return to drilling.

To reduce costs, various systems have been developed for performing formation testing through a drill string without pulling the drill string and without removing the drill bit. However, these systems tend to be complicated and therefore expensive and prone to failure. Systems for inflating and deflating packers to provide the necessary formation isolation have been complicated, often including down hole pumps and fluid reservoirs. Such systems typically occupy space in the normal mud flow path through the drill string and interfere with running test equipment through the mud flow path to the bottom hole location.

Therefore, there is a need for simple and robust systems suitable for use in a drill string for inflating and deflating formation isolating packers and for opening and closing flow paths for formation testing and for reverse circulation.

SUMMARY OF THE INVENTION

In one embodiment the present disclosure provides a borehole tubular element having a port from an internal flow path to the outer surface of the element, a sliding sleeve for controlling flow through the port and shifting tool for moving the sleeve to selectively open or close the port. The sleeve has a radially compressible portion which carries an external profile which mates with a complementary internal profile in the tubular element in a first sleeve position. The shifting tool has two shoulders for engaging and moving the sleeve. A first shoulder engages the upper end of the sleeve to drive the sleeve down to a second position. In the second position the sleeve external profile is forced out of the tubular element recessed profile compressing the sleeve. When compressed, an internal profile on the sleeve has an inner diameter smaller than the second shoulder on the shifting tool. Upon moving the shifting tool up hole, the second shoulder engages the sleeve internal profile and moves the sleeve up until its external profile enters the tubular element internal profile and the sleeve expands to its original diameter.

One embodiment of the present disclosure provides a drill string joint having an external inflatable packer for isolating a borehole zone. An internal packer inflation sleeve controls flow of fluid through a packer inflation port between the drilling fluid flow path in the joint and the inflatable packer. A packer inflation shifting tool transported down the drilling fluid flow path carries a seal for closing the drilling fluid flow path to the drill bit and a shoulder for shifting the sliding sleeve to open the packer inflation port so that drilling fluid pressure can inflate the packer. The packer inflation shifting tool includes a second shoulder for moving the sliding sleeve back to close the packer inflation port when the tool is transported back up the drilling fluid flow path.

In one embodiment, the inflatable packer has one end fixed to the drill string joint. The other end is connected to an external sliding sleeve. The joint includes a formation fluid port which is closed by the sliding sleeve when the packer is not inflated. Upon inflation of the packer, its length is reduced and the sliding sleeve moves to open the formation fluid port.

In one embodiment, a circulation port is provided above the packer. An internal circulation control sleeve controls flow of fluids between the mud flow path and the annulus between the drill string and the borehole. A circulation shift tool transported down the mud flow path has a first shoulder for shifting the circulation control sleeve to open the circulation port so that drilling fluid may be flowed down the annulus and up the drilling fluid flow path or vice versa. The circulation shift tool includes a second shoulder for moving the sliding sleeve back to close the circulation port when the tool is transported back to the drilling fluid flow path.

DETAILED DESCRIPTION OF THE INVENTION

Figure 1:
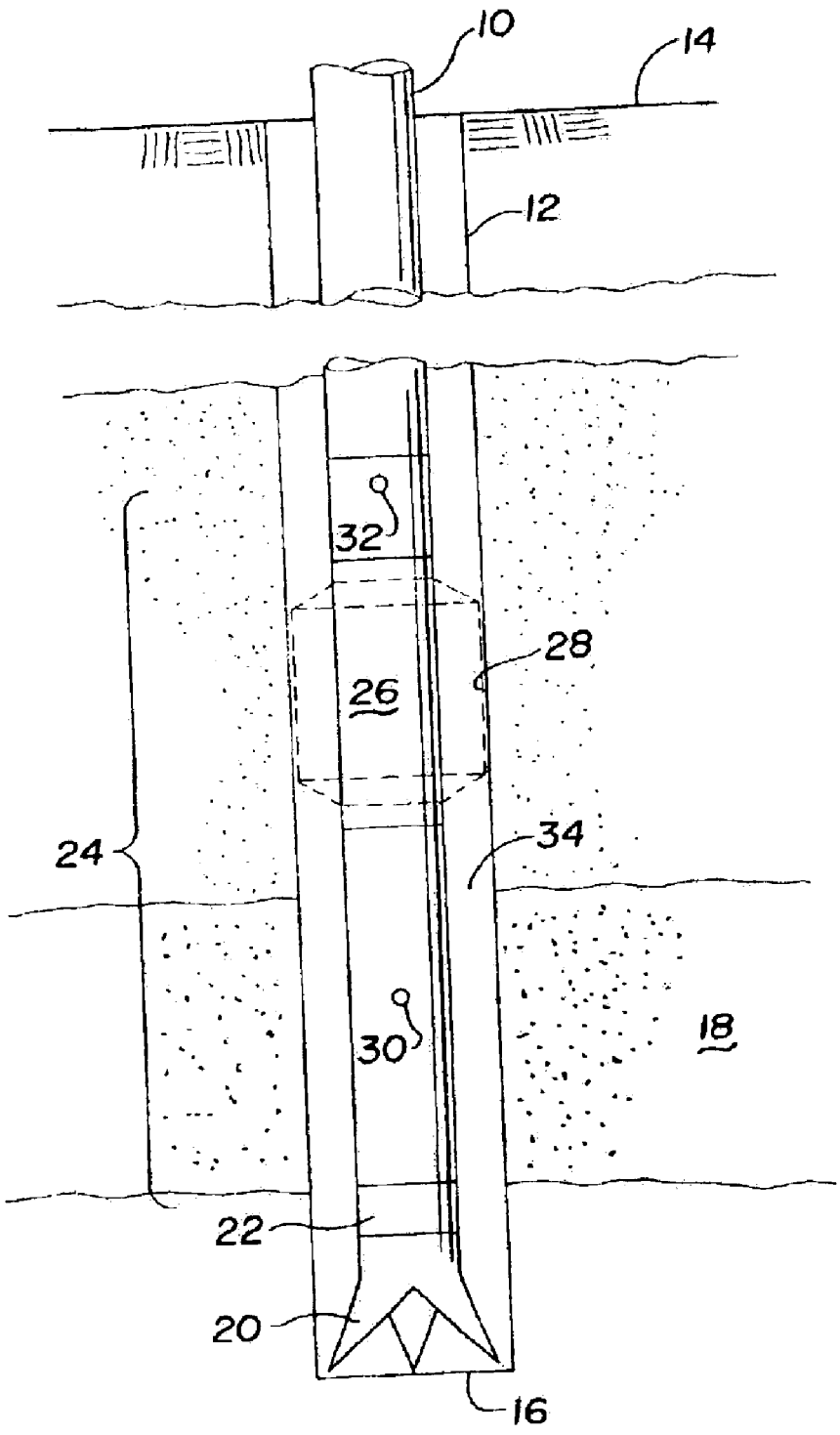
FIG. 1 is a schematic illustration of a portion of a drill string in a borehole including a testing packer joint in accordance with the present disclosure.

FIG. 1 provides a general illustration of the external elements of the present disclosure installed in an operating drill string. A drill string 10 is shown in a borehole 12 extending from the surface of the earth 14 to a bottom hole location 16. The borehole 12 has passed through a potentially productive zone 18. The drill string 10 includes a drill bit 20 on its lower end and a float collar 22 above the bit 20. A testing assembly 24 according to the present disclosure is included as part of the drill string 10 above the float collar 22. The assembly 24 includes an inflatable packer 26 positioned above zone 18. When packer 26 is inflated, it expands against the wall of borehole 12 as indicated by the dashed lines 28. The assembly 24 also includes a formation fluid port or flow path 30 below packer 26 through which fluids from the formation 18 may flow into drill string 10 during testing. An external sleeve attached to packer 26 and described in detail below is provided for selectively opening and closing the flow path 30. The flow path 30 is therefore not actually visible externally unless it is open. The assembly 24 may also include a drilling fluid bypass or circulation port 32 above the packer 26. An internal sleeve, described in detail below, is provided for selectively opening and closing the flow path 32. The internal structure of the testing assembly 24 is described with reference to detailed drawings below.

Figure 2:
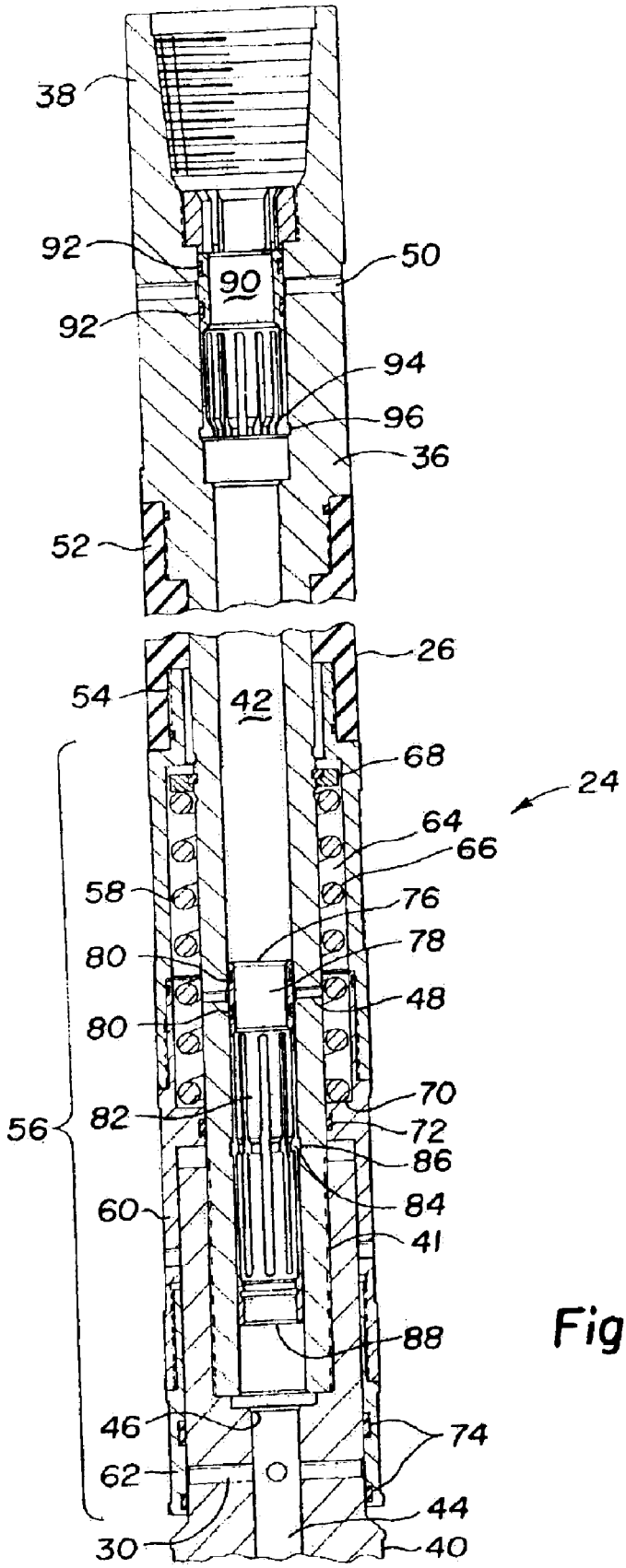
FIG. 2 is a cross sectional illustration of a testing assembly of the present disclosure in its drilling configuration.

FIG. 2 provides a cross sectional illustration of an embodiment the testing assembly 24 of the present disclosure configured for drilling operations. In this configuration, the drill string 10, FIG. 1, may be rotated to turn drill bit 20 while drilling fluid is pumped down the drill string 10 and up the annulus 34, FIG. 1, between the drill string 10 and the wall of borehole 12 in accordance with standard drilling practice. The assembly 24 is assembled on a solid mandrel 36 having sufficient strength to act as a part of a drill string. A standard drill string female threaded coupling 38 is attached to, or formed as part of, the upper end of the mandrel 36. A standard drill string male threaded coupling 40 is attached to the lower end of mandrel 36 by, in this embodiment, a threaded joint 41. With these primary structural elements, 36, 38 and 40, the testing assembly 24 is easily assembled with other drill string components. The terms upper and lower are used herein to refer to directions in a borehole relative to the surface location 14 of the well. For example, in a slanted well, the portion closest to the surface location is considered the upper end, even if it actually lies at a lower elevation than the end 16 of the borehole.

Four fluid flow paths are provided through the mandrel 36. A conventional drilling fluid flow path 42 is provided through the central axis of the mandrel 36. This path 42 allows drilling fluids to be pumped from up hole to drill bit 20 down hole from the assembly 24. The flow path 42 includes a reduced diameter portion 44 at its lower end, thereby forming a shoulder 46. The formation fluid port 30 of FIG. 1 may include a plurality of ports, in this example four, on the lower end of mandrel 36 as illustrated extending from the drilling fluid flow path section 44 to the outer surface of mandrel 36. A packer inflation port 48 extends from the drilling fluid flow path 42 to the outer wall of mandrel 36 at a location where it provides communication with the packer 26. A drilling fluid bypass port 50 is located in the upper end of the mandrel 36 and provides a flow path between the drilling fluid flow path 42 and the outer surface of the mandrel 36. The present disclosure provides means for controlling fluid flow through all four of these flow paths 42, 30, 48 and 50, as described in detail below.

The packer 26 is carried on the outside of mandrel 36. An upper end 52 of packer 26 is attached to the outer surface of mandrel 36 with a nonmovable fluid tight seal. That is, upon expansion and contraction of packer 26, its upper end 52 does not move relative to the mandrel 36. A lower end 54 of packer 26 is attached to a sliding sleeve 56. The sleeve 56 in this embodiment is manufactured as three separate sections 58, 60 and 62, which, when assembled, function as a single sliding sleeve. The attachment of the lower end 54 of packer 26 to section 58 of sleeve 56 is also a fluid tight seal which does not move relative to the sleeve 56, although the sleeve 56 moves relative to mandrel 36 upon inflation and deflation of the packer 26.

Sleeve 56 sections 58 and 60 together define an annular space 64 around mandrel 36 in which may be carried a coil spring 66. The spring 66 is captured between a spring stop ring 68 attached to the outer surface of mandrel 36 and a shoulder 70 on the inner surface of sleeve section 60. The spring 66 aids in deflating and resetting the packer 26 as explained below. Since pressure differential should be sufficient to deflate and reset the packer 26, the spring 66 is not essential but is preferred. A high pressure sliding seal 72 is provided between shoulder 70 and the outer surface of mandrel 36. The annular space 64 is in fluid communication at its upper end with space between packer 26 and mandrel 36, but is sealed at its lower end by the sliding seal 72. The lowermost section 62 of sleeve 56 is carried on the lower end of section 60, and in this drilling configuration covers the formation flow ports 30. A pair of sliding seals 74 are carried between the sleeve 56 section 62 and the outer surface of mandrel 36 to seal the ports 30 in this drilling configuration.

The test assembly 24 includes two internal sliding sleeves carried in the drilling fluid flow path 42 for controlling fluid flow through ports 48 and 50. One sliding sleeve 76 acts as a packer inflation port 48 control valve. The upper end 78 of sleeve 76 is a hollow cylinder with a pair of sliding seals 80 between the sleeve 76 and the inner surface of mandrel 36, i.e. the wall of drilling fluid flow path 42. In this drilling configuration, the seals 80 are positioned on opposite sides of the packer inflation port 48 and prevent flow of fluids through port 48. A central portion 82 of sleeve 76 is axially slotted so that it is radially compressible. This structure is sometimes referred to as a collet. Near the center of central portion 82, an external profile 84 extends into a mating recessed profile 86 in the wall of flow path 42. The profiles 84 and 86 are complementary and designed to mate to enable external profile 84 to fit inside recessed profile 86. Complementary profiles are not required to be identical, although in some embodiments the profiles may be exact complements, but only required to have complementing shapes which may fit and engage (mate) in the desired positions. In the disclosed embodiment, each profile 84, 86 has an upper surface substantially at right angles to the axis of mandrel 36, so that when engaged they stop further up hole movement of the sleeve 76. Each profile 84, 86 has a lower surface slanted at an angle less than ninety degrees relative to the axis of mandrel 36, so that with sufficient down hole force on the sleeve 76, the profile 84 will move inward and out of the profile 86 allowing the sleeve 76 to move down hole. Until such force is applied, the mating profiles 84 and 86 hold the sleeve 76 in position to keep packer inflation port 48 closed. The sleeve 76 may also include an unslotted lowermost section 88.

In one embodiment, a second sliding sleeve 90 is positioned in the upper end of mandrel 36 and functions as a control valve for the circulation port 50. It is very similar in construction to the sleeve 76. An upper end of sleeve 90 is a hollow cylinder with a pair of sliding seals 92 between the sleeve 90 and the inner surface of mandrel 36, i.e. the wall of drilling fluid flow path 42. In this drilling configuration, the seals 92 are positioned on opposite sides of the circulation port 50 and prevent flow of fluids through port 50. A lower end of sleeve 90 is axially slotted so that it is radially compressible. On the lowermost end of sleeve 90, external profiles 94 extend from the sleeve 90 and mate with corresponding recessed profile 96 in the inner wall of flow path 42. These mating profiles 94 and 96 have upper and lower surfaces like those on profiles 84 and 86, which prevent up hole movement of sleeve 90, but allow down hole movement if sufficient down hole force is applied to the sleeve 90 to move the profiles 94 inward and out of profiles 96. Until such down hole force is applied, these mating profiles 94 and 96 hold the sleeve 90 in position to keep circulation port 50 closed.

Figure 3:
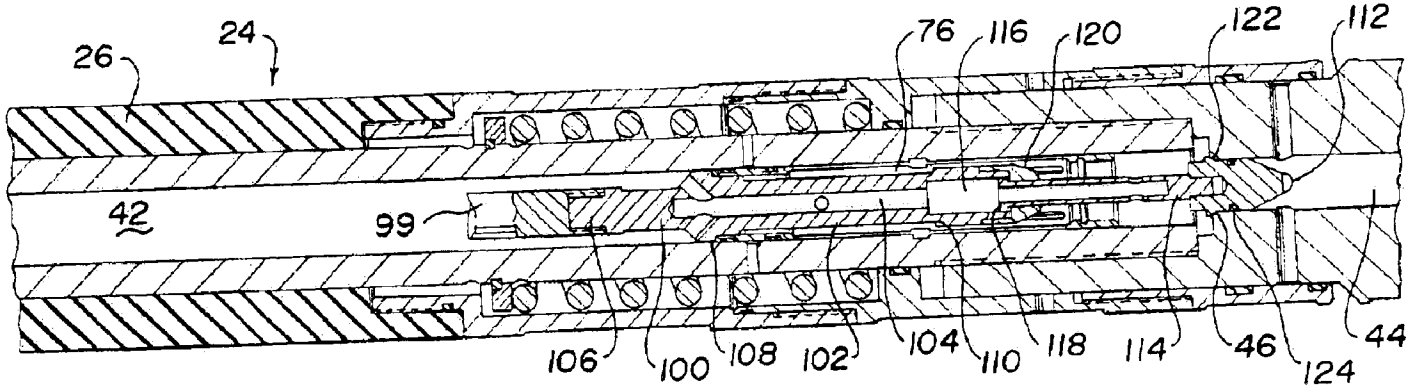
FIGS. 3 and 3A are cross sectional illustrations of the testing assembly of the present disclosure with a packer inflation shifting tool in a first position in preparation for inflating the packer.
Figure 3A:
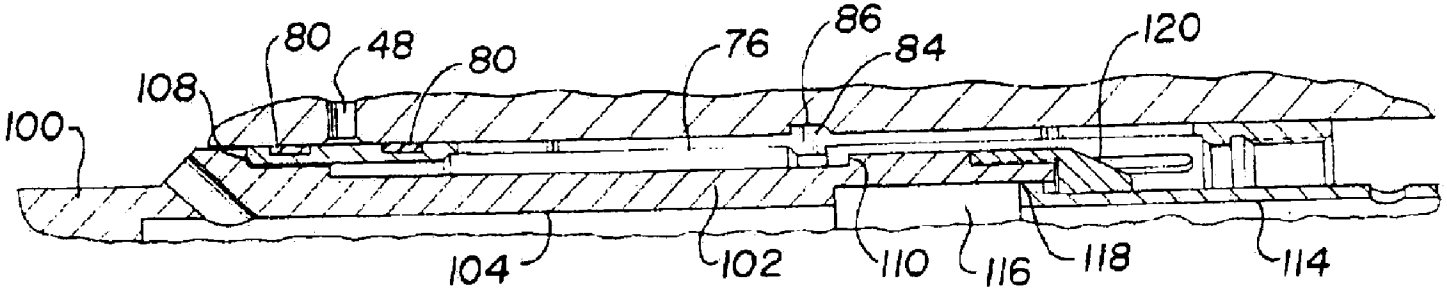

FIG. 3 provides an illustration of a configuration of the test assembly 24 when drilling has stopped and the packer 26 is about to be inflated. FIG. 3A provides more detail of the sleeve 76, particularly the external profile 84 and its interaction with the internal profile 86 in the wall of drilling fluid passage 42. A packer inflation shifting tool 100 has been transported down through the drilling fluid flow path 42, preferably by means of a slick line 99. This shifting tool 100 has only two parts which move relative to each other in operation. The tool 100 includes a cylindrical housing 102 having an axial flow path 104 from its upper end to its lower end. It includes a threaded section 106 on its upper end for connection to a conveyance means such as slick line 99. The outer surface of the housing 102 has a reduced diameter portion forming a downward facing shoulder 108 near its upper end and an upward facing shoulder 110 near its lower end. The tool 100 includes a nosepiece 112 slidably coupled to the lower end of the housing 102. A hollow rod or shaft 114 is attached to the nosepiece 112 on one end and has a second end carried within an enlarged portion 116 of the flow path 104. The second end of shaft 114 is retained in the flow path portion 116 by means of a flange 118 on the shaft 114 and a cap 120 connected to the housing 102.

In the FIGS. 3 and 3A configuration, the shifting tool 100 has been lowered down the flow path 42 until the nosepiece 112 has entered the drilling fluid flow path 42 reduced diameter section 44. At this point an external flange 122 on the nosepiece engages the shoulder 46 and stops further downward movement of nosepiece 112. A seal 124 carried on nosepiece 112 forms a fluid tight seal stopping flow of fluid from the flow path 42 down to the drill bit 20. All portions of the shifting tool 100 have a small enough outer diameter to pass through the inflation control sleeve 76 in the drilling configuration, except for the shoulder 108 which engages the upper end of the sleeve 76.

Figure 4:
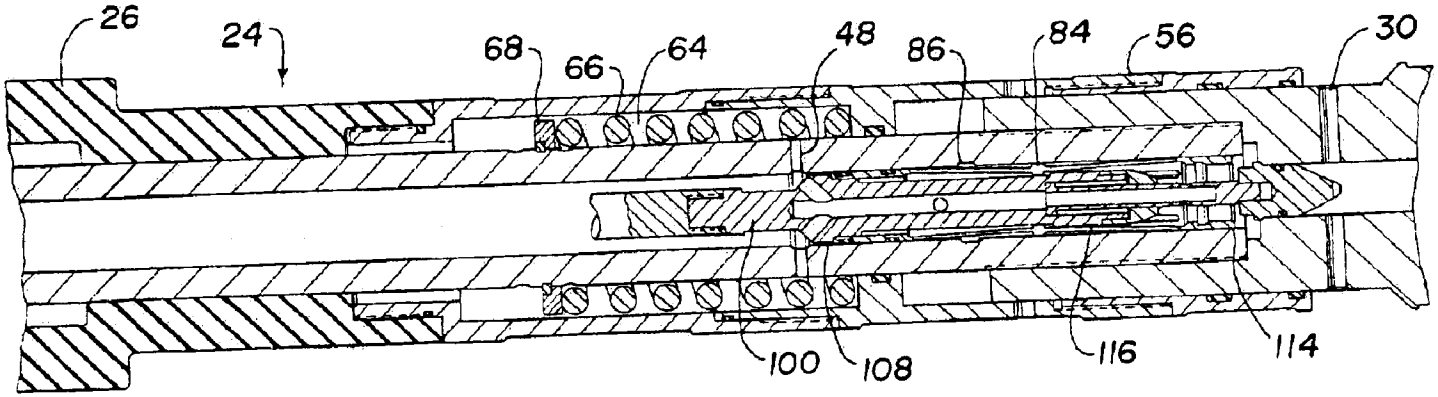
FIGS. 4 and 4A are cross sectional illustrations of the testing assembly of the present disclosure with a packer inflation shifting tool in a second position in which the packer may be inflated.
Figure 4A:
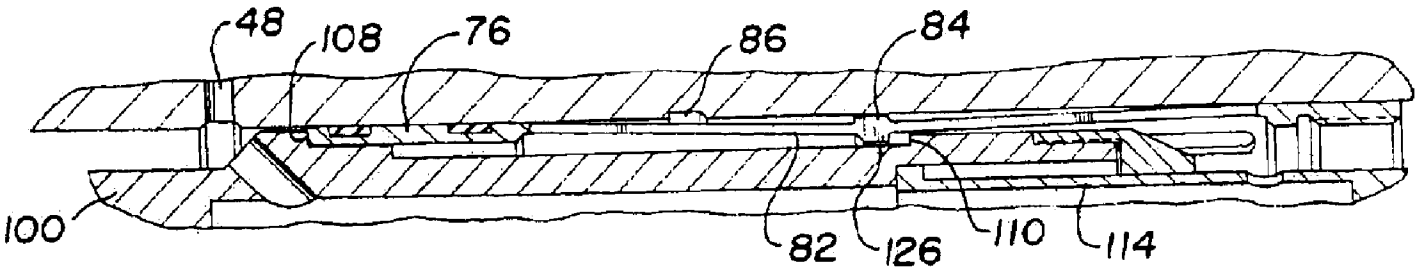

FIG. 4 illustrates the configuration of the test assembly 24 during inflation of packer 26. FIG. 4A provides more detail of the sleeve 76, particularly the external profile 84 and its interaction with the internal profile 84 in the wall of drilling fluid passage 42. The shifting tool 100 has been lowered down the flow path 42 as far as it can go. The limit of movement is reached when the upper end of rod 114 contacts the upper end of chamber 116. During this movement, the shoulder 108 on shifting tool 100 has forced the sleeve 76 down the flow path 42, until the inflation ports 48 have been opened. In addition, the external profile 84 on sleeve 76 has been forced inward and out of the recessed profile 86. As a result, the center slotted portion 82 of sleeve 76 has been compressed radially to a smaller diameter. When this occurs, internal profiles 126 on sleeve 76 are forced into the reduced diameter portion of the tool 100 outer surface and have a smaller diameter than the upward facing shoulder 110. The shoulder 110 and the down hole surface of profile 126 may be at angles of ninety degrees relative to the axis of mandrel 36, but are preferably at angles somewhat less than ninety degrees.

When the configuration of FIG. 4 has been achieved, drilling fluid may be pumped down the flow path 42 at a pressure suitable to inflate the packer and out through inflation ports 48. The seal 124 on nosepiece 112 prevents this pressure from reaching the borehole and possibly causing formation damage. The fluid may then flow through the annular space 64, around the spring 66 and spring retainer 68 and then under the packer 26. As illustrated, the packer 26 will then expand into contact with the borehole wall. As packer 26 expands in diameter, the axial distance between its ends is reduced. The reduction in packer length pulls the external sleeve 56 up hole and exposes or opens the formation port 30. As sleeve 56 moves up hole, it compresses spring 66.

If desired, the packer inflation port 48 could be positioned directly under the packer 26. This can be done by moving the shoulder 46 up the drilling fluid flow path 42 by the appropriate distance. The tool 100 would not need to be changed. However, the illustrated embodiment is preferred for several reasons. If the port 48 is placed directly under the packer 26, the packer may be damaged by fluids flowing through the port 48 and impacting the inner surface of packer 26, especially if any particulate matter is in the drilling fluid. Particulate matter may also be trapped under the packer 26 when it is deflated, preventing complete deflation and damaging the packer 26 during continued drilling operations. In the preferred embodiment, the drilling fluid travels up hole through the spring annulus 64 and around spring 66 before it enters the packer 26. This allows separation of particulates from the drilling fluid before it reaches the packer 26. Particulates may be trapped in the chamber 64 which is made of more rugged materials than the inflatable packer 26. In this manner chamber 64 and spring 66 may act as a rudimentary filter reducing contamination by larger particulate matter.

Figure 5:
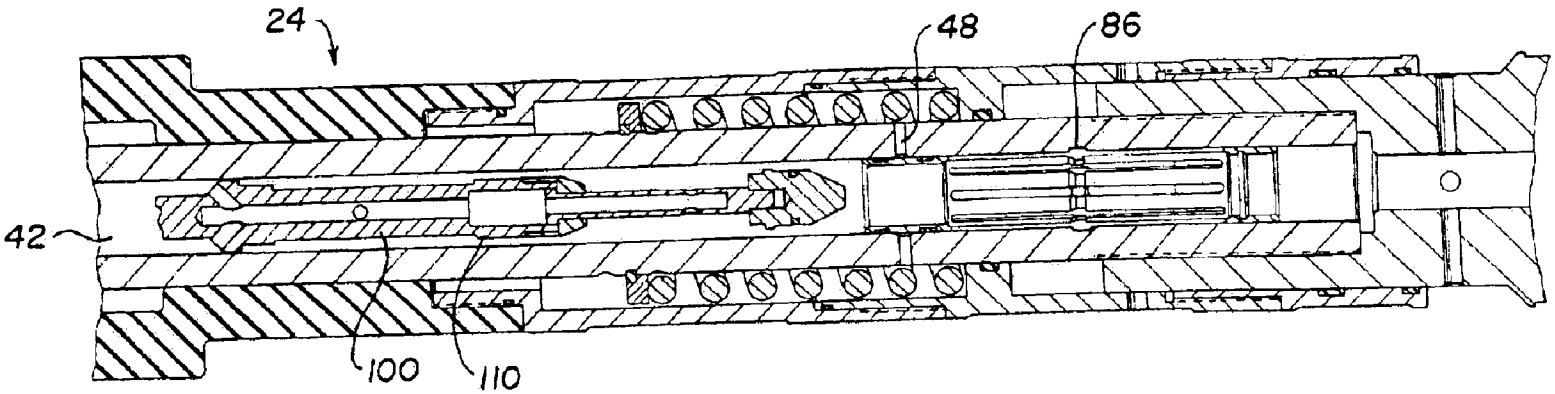
FIG. 5 is a cross sectional illustration of the testing assembly of the present disclosure with a packer inflation shifting tool withdrawn from the packer inflation control sleeve so that formation testing can commence.

FIG. 5 illustrates the test assembly 24 as the shifting tool 100 is removed in preparation for formation testing. In the FIGS. 4 and 4A configuration, the internal profiles 126 of sleeve 76 are in a reduced diameter condition in which their inner diameter is less than the outer diameter of shoulder 110 on the tool 100. As a result, when the tool 100 is moved back up hole, the shoulder 110 engages the profiles 126 and moves the sleeve 76 up hole also. This movement continues until the sleeve 76 external profiles 84 reach the recessed profiles 86 on the inner surface of the mandrel 36. At that point the slotted portion of sleeve 76 returns to its original larger diameter and the internal profiles 126 are released from the shoulder 110. As stated above, it is desirable that the surfaces of profile 126 and shoulder 110 which contact each other are at angles somewhat less than ninety degrees relative to the axis of mandrel 36, but about a ninety degree angle could also be acceptable. Angles slightly less than ninety degrees will provide some outward force on profile 84 as it is pushed back toward profile 86 and help ensure that profile 84 will enter profile 86 and release from shoulder 110. At that point the sleeve 76 is again locked into a position closing the packer inflation port 48. Once the port 48 is closed, the high pressure fluid in packer 26 is trapped and the packer remains inflated. The pressure in flow path 42 may then be lowered to facilitate further movement of the shifting tool 100 up hole. Note that a pressure differential may occur across the nose piece 112 during inflation of the packer 26 which would resist removal of the nose piece 112. Fluid paths through tool 100 prevent a pressure differential across the main body of tool 100.

In FIG. 5 the shifting tool 100 is shown as only partially withdrawn. Formation testing can be performed with the tool 100 still in the flow path 42 or anywhere else up hole. However, it is preferred to completely withdraw the tool 100 from the drill string during formation testing. A typical formation test involves allowing fluids from the formation 18 to flow into the flow path 42 and at least part way up the drill string. This not only allows collection of fluid samples, but also allows measurement of flow rate and, by closing the flow path, measurement of pressure build up. If desired, instruments for measuring parameters such as pressure and temperature may be run down the flow path 42.

Figure 6:
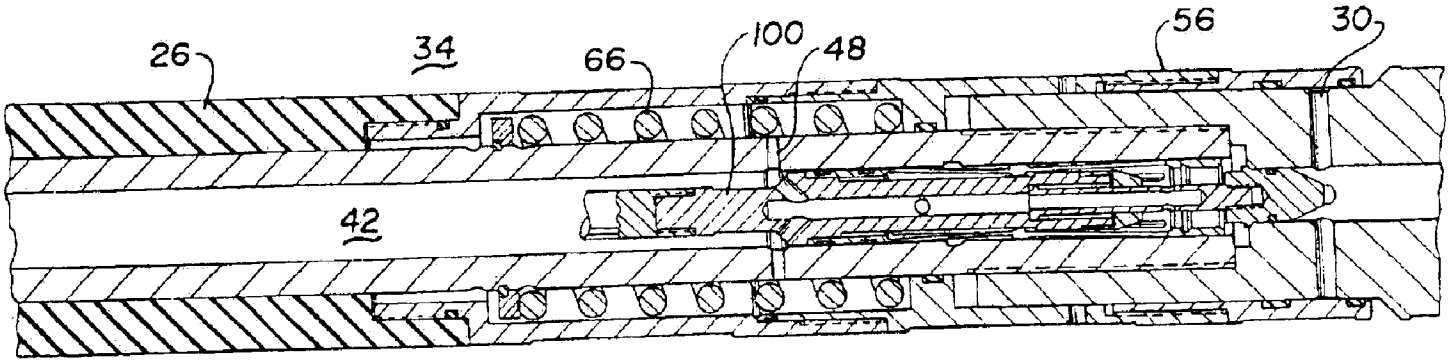
FIG. 6 is a cross sectional illustration of the testing assembly of the present disclosure with a packer inflation shifting tool reinserted for deflation of the packer.

FIG. 6 is essentially identical to FIG. 4, except that the packer 26 has been deflated. After the desired formation tests have been performed, the shifting tool 100 is reinserted into the test assembly 24 to reopen the packer inflation port 48. However, the pressure in flow path 42 is reduced at this time. The pressure may be significantly reduced because the produced fluids which may now fill a portion of the drill string may be significantly less dense than the drilling fluid in the annulus 34. As a result of the pressure differential and the compressed spring 66, the fluid in packer 26 is released and the packer is deflated. As this occurs, the external sleeve 56 is forced back down hole until it covers and seals the formation test port 30. Once the packer 26 is deflated, the shifting tool 100 is again removed from the test assembly 24, closing the packer inflation port 48.

As noted above, after formation testing, the drill string is typically filled with produced fluids. It is usually desirable to collect these fluids with little or no mixing with drilling fluids or other fluids which may be produced elsewhere in the borehole. As a result, it is normal practice to reverse circulate the well, i.e. pump drilling fluid down the annulus 34 instead of down the drill string, and drive the produced fluids to the surface through the drill string. However, it is also normal to have a float collar 22 as shown in FIG. 1, which prevents flow of fluids up through the drill bit 20.

Figure 7:
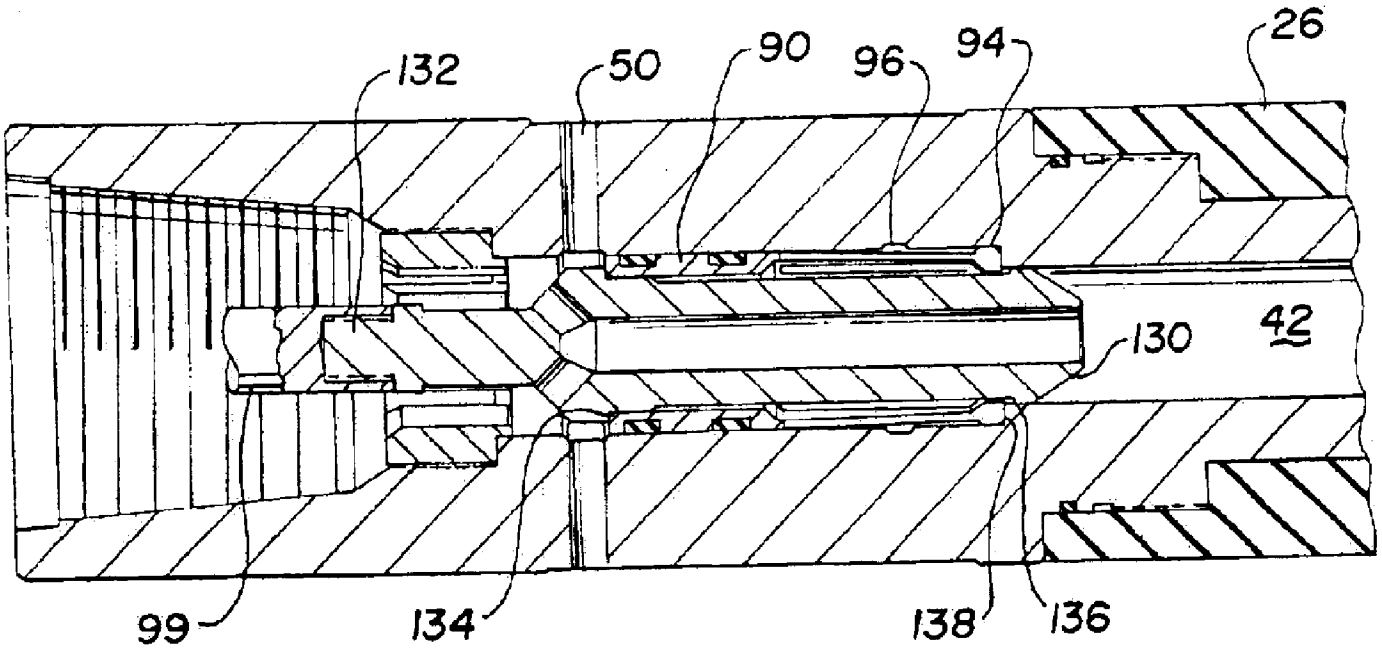
FIG. 7 is a cross sectional illustration of the testing assembly of the present disclosure showing a circulating shift tool opening a circulation port.

FIG. 7 illustrates use of a circulation shifting tool 130 to move the sleeve 90 and open the circulation port 50. The structures and functions of the shift tool 130 and sleeve 90 are essentially the same as the structures and functions of shifting tool 100 and sleeve 76. The shifting tool 130 is a single part shaped like the housing portion of shifting tool 100. However, tool 130 and sleeve 90 are of slightly larger diameters, because in operation of the packer inflation tool 100, it must pass through the circulation control sleeve 90. The tool 130 has a threaded end section 132 for connection to a conveyance means such as slick line 99. The main body of the tool 130 includes a reduced diameter outer portion which provides a downward facing shoulder 134 near its upper end and an upward facing shoulder 136 near its lower end.

In FIG. 7, the shifting tool 130 has been lowered into the flow path 42 until its downward facing shoulder 134 has contacted the upper end of sleeve 90 and driven the sleeve 90 down hole sufficiently to open the circulation port 50. Downward movement of the tool 130 and sleeve 90 are limited by a shoulder 138 in flow path 42. As the sleeve 90 moved downward, its outward extending profiles 94 on its slotted lower end were forced out of the recessed profiles 96 in the mandrel 36. This inward movement of the profiles 94 reduces the inner diameter of the lower end of sleeve 90 to less than the diameter of upward facing shoulder 136 on tool 130. Upon moving the tool 130 up hole, the shoulder 136 engages the lower end of sleeve 90 and moves it up hole. When the external profiles 94 reach the recessed profile 96, the sleeve 90 expands to its original diameter and its lower end is released form the shoulder 136 on the tool 130. Thus, when tool 130 is withdrawn, the sleeve 90 will be returned to its original position closing the port 50.

Before closing the port 50, and with the shifting tool 130 in position as shown in FIG. 7, the well may be reverse circulated. Drilling fluid pumped down the annulus 34 will flow through port 50 and up the drill string, driving produced fluids in the drill string to the surface 14 where they can be collected. Note that due to the float collar 22, fluids below the circulation port 50 will not be recovered by reverse circulation. This avoids pumping of drill cuttings which may be present in the drill bit 20 up the drill string.

In the embodiment described above, the circulation port 50 and its control sleeve 90 are part of the same joint or sub on which the packer 26 and other elements are assembled. It is apparent that the port 50 and sleeve 90 could be part of a separate joint or sub and could be assembled as part of a drill string at any distance up hole from the packer 26.

The test assembly 24 of the present disclosure provides a simple and cost effective system for testing earth formations through a drill string while drilling wells. The test assembly 24 may be included in a drill string as shown in FIG. 1. After a potentially productive zone 18 has been drilled through, drilling is stopped. The packer inflation tool 100 is then run down the drill string to close the drilling fluid path to the drill bit 20 and open the packer inflation port 48. Drilling fluid pressure is then increased to inflate the packer 26, isolating the zone 18 and opening the formation test port 30. The inflation tool 100 is then removed from the drill string, which closes the packer inflation port 48. Formation testing is then performed. When testing is completed, the inflation tool 100 is run back to the assembly 24, where it opens the port 48, deflating the packer 26. Deflation of packer 26 moves sleeve 56 and closes the formation port 30. The tool 100 is then withdrawn, again closing the inflation port 48. The circulation tool 130 is then run down to the circulation sleeve 90 to open the circulation port 50. Produced fluids in the drill string are then recovered by reverse circulation of drilling fluid. Once the fluids are recovered, the circulation tool 130 is withdrawn, closing the circulation port 50.

After such a test cycle has occurred, drilling can be continued. When another potentially productive zone has been drilled through, the same testing procedure may be repeated. The test process can be repeated as often as desired, without removing and reinstalling the drill string.

While the test assembly 24 has been shown in use as part of a drill string, it is apparent that the apparatus of the present disclosure may be used in other tubular goods commonly used in boreholes. For example, it could be used as part of a separate work string, test string or production string for setting a packer. The string could be run into a cased well and the packer deployed to seal the annulus between the string and the casing. All parts of the assembly 24 do not necessarily need to be used together. For example, the circulation port 50 and its control sleeve 90 are preferred if the tubing string has a float valve which prevents reverse circulation of drilling fluid. But, even if such a valve is in the string, it is possible to use normal circulation to pump produced fluids out of the well and the reverse circulation port would not be needed. The combination of the inflatable packer 26 with the external sliding sleeve 56 and port 30 may be useful in various down hole systems without the rest of the test assembly 24. For example, the port 30 could be used for injecting fluids into the formation, as opposed to producing fluids from the formation. In such injection processes, it is often necessary that a packer be set above the injection point to prevent the fluids from flowing up the annulus. The sleeve 56 would prevent the injection of fluids until the packer is set.

In another embodiment, the present system may be employed to perform a formation integrity or formation leak off test. For example, a test may be conducted after cementing the surface pipe and may also be conducted after the intermediate casing if the well profile calls for an intermediate casing to be used. After cementing the casing in place and waiting an appropriate time, an additional 5–10 feet of drilling is performed below the casing. The string is then preferably positioned so that the inflatable packer inflates against the casing sealing off the open hole area below the casing. With the formation flow port opened, the mud is pressured up on the open hole slowly and the mud flow monitored to note the pressure at which the open hole starts to take fluid into the formation. This pressure is than calculated back to a specific fluid weight to define a maximum fluid weight which can be used while drilling the well with reduced risk of forcing drilling fluid into the formation itself. Using tools disclosed herein, an operator should be able to drill and then test without having to make a trip to run a casing packer. In another embodiment a similar test may be run further down in the drilling process to check any formations that might be of concern. In this embodiment the inflatable packer would likely be inflated in the open hole rather than in the cased formation.

It is apparent that various changes can be made in the apparatus and methods disclosed herein, without departing from the scope of the invention as defined by the appended claims.

What we claim is:

1. A test assembly, comprising:

a mandrel having an internal fluid flow path, an inflatable packer carried on the mandrel, an inflation flow path from the internal flow path to the packer, an inflation control sleeve carried within the internal flow path, closing the inflation flow path in a first axial position and opening the inflation flow path in a second axial position, and an inflation shifting tool transportable through said internal fluid flow path adapted to mechanically engage the control sleeve to mechanically move it from the first axial position to the second axial position, and to mechanically engage the control sleeve to mechanically move it from the second axial position to the first axial position.

2. A test assembly according to claim 1, wherein the inflation shifting tool has a first shoulder for engaging the control sleeve to move it from the first axial position to the second axial position, and a second shoulder for engaging the control sleeve to move it from the second axial position to the first axial position.

3. A test assembly according to claim 2, wherein the inflation control sleeve has an upper end having an inner diameter smaller than the diameter of the shifting tool first shoulder.

4. A test assembly according to claim 3, wherein the inflation shifting tool second shoulder engages the control sleeve when the inflation control sleeve is in the second axial position, but not when the inflation control sleeve is in the first axial position.

5. A test assembly according to claim 4, wherein the inflation control sleeve has a radially compressible portion and the mandrel has a recessed profile in the internal flow path.

6. A test assembly according to claim 5, further comprising:

an external profile on the control sleeve compressible portion, the external profile complementing the shape of the mandrel recessed profile, and an internal profile on the control sleeve compressible portion, said internal profile having an inner diameter greater than the diameter of the second shoulder when the control sleeve external profile is mated with the mandrel recessed profile, and having an inner diameter less than the diameter of the second shoulder when the control sleeve external profile is not mated with the mandrel recessed profile.

7. A test assembly comprising:

a mandrel having an internal fluid flow path, an inflatable packer carried on the mandrel, an inflation flow path from the internal flow path to the packer, an inflation control sleeve carried within the internal flow path, closing the inflation flow path in a first axial position and opening the inflation flow path in a second axial position, an inflation shifting tool transportable through said internal fluid flow path adapted to engage the control sleeve to move it from the first axial position to the second axial position, and to engage the control sleeve to move it from the second axial position to the first axial position, a formation fluid flow path from the internal path to the outer surface of the mandrel below the packer, and an external sleeve slidably carried on the mandrel coupled to one end of the inflatable packer and closing the formation flow path when the packer is not inflated and opening the formation flow path when the packer is inflated.

8. A test assembly according to claim 7, further comprising a seal carried on the inflation shifting tool closing the mandrel internal flow path below the inflation flow path when the inflation control sleeve is in the second axial position.

9. A test assembly further comprising:

a mandrel having an internal fluid flow path, an inflatable packer carried on the mandrel, an inflation flow path from the internal flow path to the packer, an inflation control sleeve carried within the internal flow path, closing the inflation flow path in a first axial position and opening the inflation flow path in a second axial position, an inflation shifting tool transportable through said internal fluid flow path adapted to engage the control sleeve to move it from the first axial position to the second axial position, and to engage the control sleeve to move it from the second axial position to the first axial position, a circulation flow path from the internal flow path to the outer surface of the mandrel above the packer, and a circulation control sleeve carried within the internal flow path, closing the circulation flow path in a first axial position and opening the circulation flow path in a second axial position.

10. A test assembly according to claim 9, further comprising a circulation shifting tool transportable through said internal fluid flow path having a first shoulder for engaging the control sleeve to move it from the first axial position to the second axial position, and a second shoulder for engaging the control sleeve to move it from the second axial position to the first axial position.

11. A method for testing an earth formation, comprising:

installing a tubular element in a well bore, the element having an internal flow path, an inflatable packer on its outer surface, an inflation flow path between the internal flow path and the packer, and an inflation control sleeve slidably carried in the internal flow path, moving a shifting tool through the internal flow path to mechanically engage and mechanically move the inflation control sleeve and open the inflation flow path, pumping fluid through the internal flow path and the inflation flow path and into the packer, and moving the shifting tool in the internal flow path to mechanically engage and mechanically move the control sleeve and close the inflation flow path.

12. A method according to claim 11, further comprising flowing formation fluids through the internal flow path.

13. A method according to claim 12, further comprising testing at least one property of the formation fluids flowed through the internal flow path.

14. A method according to claim 12, further comprising:

moving the shifting tool through the internal flow path to move the inflation control sleeve and open the inflation flow path, lowering fluid pressure in the internal flow path and flowing fluids from the packer, through the inflation flow path into the internal flow path, and moving the shifting tool in the internal flow path to move the control sleeve and close the inflation flow path.

15. A method according to claim 13, further comprising:

moving the shifting tool through the internal flow path to move the inflation control sleeve and open the inflation flow path, lowering fluid pressure in the internal flow path and flowing fluids from the packer, through the inflation flow path into the internal flow path, and moving the shifting tool in the internal flow path to move the control sleeve and close the inflation flow path.

16. A method for testing an earth formation, comprising:

installing a tubular element in a well bore, the element having an internal flow path, an inflatable packer on its outer surface, an inflation flow path between the internal flow path and the packer, an inflation control sleeve slidably carried in the internal flow path, a formation fluid flow path from the internal path to the outer surface of the mandrel below the packer, and an external sleeve slidably carried on the mandrel having one end coupled to one end of the inflatable packer;

moving a shifting tool through the internal flow path to move the inflation control sleeve and open the inflation flow path, pumping fluid through the internal flow path and the inflation flow path and into the packer, using the packer inflation to move the external sliding sleeve and open the formation flow path, moving the shifting tool in the internal flow path to move the control sleeve and close the inflation flow path.

17. A method according to claim 16, further comprising flowing formation fluids through the formation flow path into the internal flow path.

18. A method according to claim 17, further comprising testing at least one property of the formation fluids flowed into the internal flow path.

19. A method according to claim 17, further comprising:

moving the shifting tool through the internal flow path to move the inflation control sleeve and open the inflation flow path, lowering fluid pressure in the internal flow path and flowing fluids from the packer, through the inflation flow path into the internal flow path deflating the packer, using the packer deflation to move the external sliding sleeve and close the formation flow path, moving the shifting tool in the internal flow path to move the control sleeve and close the inflation flow path.

20. A method according to claim 18, further comprising:

moving the shifting tool through the internal flow path to move the inflation control sleeve and open the inflation flow path, lowering fluid pressure in the internal flow path and flowing fluids from the packer, through the inflation flow path into the internal flow path deflating the packer, using the packer deflation to move the external sliding sleeve and close the formation flow path, moving the shifting tool in the internal flow path to move the control sleeve and close the inflation flow path.

21. An apparatus for controlling flow of fluids through a wall of a tubular element in a well, comprising:

a tubular element adapted for use in a well, having an internal fluid flow path, and having a port extending from the internal fluid flow path leading to a fluid source outside of the internal flow path, a sleeve carried within the internal flow path, closing the port in a first axial position and opening the port in a second axial position, and a shifting tool transportable through the internal fluid flow path having a first shoulder for engaging the sleeve to move it from the first axial position to the second axial position, and a second shoulder for engaging the sleeve to move it from the second axial position to the first axial position.

22. An apparatus according to claim 21, wherein the sleeve has an upper end having a diameter smaller than the diameter of the shifting tool first shoulder.

23. An apparatus according to claim 22, wherein:

the tubular element has a recessed profile in the internal flow path, the sleeve has a radially compressible portion, has an external profile on the compressible portion, the external profile complementing the shape of the internal flow path recessed profile, and has an internal profile on the compressible portion, said internal profile having an inner diameter greater than the diameter of the second shoulder when the external profile is mated with the recessed profile, and having an inner diameter less than the diameter of the second shoulder when the external profile is not mated with the recessed profile.

24. An apparatus according to claim 21 wherein the fluid source outside of the internal flow path is the formation.

25. An apparatus according to claim 21 wherein the fluid source outside of the internal flow path is a reservoir within the tubular element but outside of the internal flow path.

26. A method for controlling flow of fluids through a wall of a tubular element in a well, comprising:

installing a tubular element in a well bore, the element having an internal flow path, having a port extending from the internal fluid flow path leading to a fluid source outside of the internal flow path, and having a sleeve slidably carried within the internal flow path, moving a shifting tool through the internal flow path and using a shifting tool first shoulder for engaging the sleeve to move it from a first axial position to a second axial position to open the port, communicating fluid through the internal flow path and the port, and moving the shifting tool in the internal flow and using a shifting tool second shoulder for engaging the sleeve to move it from the second axial position to the first axial position to close the port.

27. The method of claim 26, wherein the fluid is communicated from the internal flow path through the port and to the fluid source outside of the internal flow path.

28. The method of claim 26, wherein the fluid is communicated from the fluid source outside of the internal flow path through the port and to the internal flow path.

29. The method of claim 26, wherein:

the fluid source outside of the internal flow path is the area outside of the tubular element, and wherein the action of communicating fluid through the internal flow path and the port comprises circulating fluid from the internal flow path through the port and to the area outside the tubular element.

30. The method of claim 26, wherein:

the fluid source outside of the internal flow path is the area outside of the tubular element, and wherein the action of communicating fluid through the internal flow path and the port comprises reverse circulating fluid from the area outside the tubular element through the port and to the internal flow path.

31. The method of claim 26, wherein:

the fluid source outside of the internal flow path is the formation, and wherein the action of communicating fluid through the internal flow path and the port comprises injecting fluid from the internal flow path through the port and into the formation.

32. The method of claim 26, wherein:

the fluid source outside of the internal flow path is the formation, and wherein the action of communicating fluid through the internal flow path and the port comprises producing fluid from the formation through the port and into the internal flow path.

33. A method for controlling flow of fluids through a wall of a tubular element in a well, comprising:

installing a tubular element in a well bore, the element having an internal flow path, having a port extending from the internal fluid flow path leading to a fluid source outside of the internal flow path and having a recessed profile, installing a sleeve slidably carried within the internal flow path and having a radially compressible portion, the radially compressible portion having an external profile on the compressible portion, the external profile complementing the shape of the internal flow path recessed profile, and having an internal profile on the compressible portion, positioning the sleeve with the external profile mating the recessed profile in the internal flow path and the sleeve closing the port, moving a shifting tool having a first and a second shoulder, wherein the diameter of the first shoulder is greater than the inner diameter of the upper end of the sleeve, through the internal flow path so that the second shoulder bypasses the internal profile of the sleeve while the external profile of the sleeve is mated with the recessed profile of the internal flow path, engaging the first shoulder of the shifting tool with the upper end of the sleeve and moving the sleeve to compress the compressible portion and slide the external profile out of mating engagement with the recessed profile of the internal flow path, using the tool to continue to move the sleeve until the port is open, communicating fluid through the internal flow path and the port, and moving the shifting tool in the opposite direction and engaging the second shoulder of the shifting tool with the internal profile of the sleeve which has an inner diameter less than the diameter of the second shoulder when the external profile is not mated with the recessed profile internal flow path, using the tool to continue to move the sleeve until the external profile of the sleeve mates with the recessed profile in the internal flow path and the sleeve closes the port.

34. A circulation assembly, comprising:

a mandrel having an internal fluid flow path, a circulation flow path from the internal flow path to the outer surface of the mandrel above the packer, an circulation control sleeve carried within the internal flow path, closing the circulation flow path in a first axial position and opening the circulation flow path in a second axial position, and a circulation shifting tool transportable through said internal fluid flow path having a first shoulder for engaging the control sleeve to move it from the first axial position to the second axial position, and a second shoulder for engaging the control sleeve to move it from the second axial position to the first axial position.

35. A circulation assembly according to claim 34, wherein the circulation control sleeve has an upper end having an inner diameter smaller than the diameter of the shifting tool first shoulder.

36. A circulation assembly according to claim 35, wherein the circulation shifting tool second shoulder engages the control sleeve when the circulation control sleeve is in the second axial position, but not when the circulation control sleeve is in the first axial position.

37. A circulation assembly according to claim 36, wherein the circulation control sleeve has a radially compressible portion and the mandrel has a recessed profile in the internal flow path.

38. A circulation assembly according to claim 37, further comprising:

an external profile on the control sleeve compressible portion, the external profile complementing the shape of the mandrel recessed profile, and an internal profile on the control sleeve compressible portion, said internal profile having a diameter greater than the diameter of the second shoulder when the control sleeve external profile is mated with the mandrel recessed profile, and having an inner diameter less than the diameter of the second shoulder when the control sleeve external profile is not mated with the mandrel recessed profile.

39. A circulation assembly according to claim 34, further comprising:

an inflatable packer carried on the mandrel, an inflation flow path from the internal flow path to the packer, and an inflation control sleeve carried within the internal flow path, closing the inflation flow path in a first axial position and opening the inflation flow path in a second axial position.

40. A circulation assembly according to claim 39, further comprising an inflation shifting tool transportable through said internal fluid flow path adapted to engage the control sleeve to move it from the first axial position to the second axial position, and to engage the control sleeve to move it from the second axial position to the first axial position.

* * * * *